US008993868B2

(12) United States Patent
Angelopoulos

(10) Patent No.: US 8,993,868 B2
(45) Date of Patent: Mar. 31, 2015

(54) UNIVERSAL PICKUP

(71) Applicant: Anastasios Nikolas Angelopoulos, Pasadena, CA (US)

(72) Inventor: Anastasios Nikolas Angelopoulos, Pasadena, CA (US)

( * ) Notice: Subject to any disclaimer, the term of this patent is extended or adjusted under 35 U.S.C. 154(b) by 0 days.

(21) Appl. No.: 13/792,205

(22) Filed: Mar. 11, 2013

(65) Prior Publication Data

US 2014/0251117 A1 Sep. 11, 2014

(51) Int. Cl.
*G10H 3/18* (2006.01)
*G10H 3/14* (2006.01)

(52) U.S. Cl.
CPC ..... *G10H 3/18* (2013.01); *G10H 3/143* (2013.01); *G10H 2220/505* (2013.01)
USPC ..... 84/726; 84/727; 84/728

(58) Field of Classification Search
USPC ..... 84/726–728
See application file for complete search history.

(56) References Cited

U.S. PATENT DOCUMENTS

| | | | | | |
|---|---|---|---|---|---|
| 2,455,575 | A | | 12/1948 | Fender et al. | |
| 2,896,491 | A | | 7/1959 | Lover | |
| 2,933,967 | A | | 4/1960 | Riscol | |
| 3,035,472 | A | | 5/1962 | Freeman | |
| 3,249,677 | A | | 5/1966 | Burns et al. | |
| 3,475,543 | A | * | 10/1969 | Burns | 84/743 |
| 3,585,424 | A | | 6/1971 | Neel | |
| 3,992,972 | A | * | 11/1976 | Rickard | 84/743 |
| 4,069,732 | A | * | 1/1978 | Moskowitz et al. | 84/727 |
| 4,096,780 | A | | 6/1978 | Dawsom | |
| 4,145,944 | A | | 3/1979 | Helpinstill, II | |
| 4,348,930 | A | | 9/1982 | Chobanian et al. | |
| 4,372,187 | A | | 2/1983 | Berg | |
| 4,425,831 | A | * | 1/1984 | Lipman | 84/743 |
| 4,433,603 | A | * | 2/1984 | Siminoff | 84/726 |
| 4,499,809 | A | | 2/1985 | Clevinger | |
| 4,534,258 | A | | 8/1985 | Anderson | |
| 4,535,668 | A | | 8/1985 | Schaller | |
| 4,581,974 | A | | 4/1986 | Fender | |
| 4,624,172 | A | | 11/1986 | McDougall | |
| 4,854,210 | A | * | 8/1989 | Palazzolo | 84/726 |
| 5,029,511 | A | * | 7/1991 | Rosendahl | 84/743 |
| 5,111,728 | A | | 5/1992 | Blucher et al. | |
| 5,148,733 | A | | 9/1992 | Beller | |
| 5,252,777 | A | * | 10/1993 | Allen | 84/726 |
| 5,276,276 | A | * | 1/1994 | Gunn | 84/725 |
| 5,292,998 | A | | 3/1994 | Knapp | |
| 5,335,576 | A | | 8/1994 | Hayashi | |
| 5,336,845 | A | | 8/1994 | Lace, Sr. | |
| 5,389,731 | A | | 2/1995 | Lace | |
| 5,523,526 | A | | 6/1996 | Shattil | |
| 5,530,199 | A | | 6/1996 | Blucher | |
| 5,567,903 | A | | 10/1996 | Coopersmith et al. | |
| 5,610,357 | A | | 3/1997 | Frank-Braun | |
| 5,614,688 | A | * | 3/1997 | Donnell | 84/743 |
| 5,659,833 | A | * | 8/1997 | FitzGerald | 396/512 |
| 5,767,432 | A | * | 6/1998 | Randolph | 84/743 |
| 6,043,422 | A | * | 3/2000 | Chapman | 84/723 |
| 6,111,184 | A | * | 8/2000 | Cloud et al. | 84/723 |

(Continued)

OTHER PUBLICATIONS

"Vintage Vibe Guitars SP-90 and H540-42 SW Pickups" by Dave Hunter, Guitar Player; Sep. 2009; 43, 9; p. 98.*

(Continued)

*Primary Examiner* — David S. Warren

(57) ABSTRACT

A musical instrument pickup including an apparatus that allows for easy interchangement of magnets for modifying tone.

20 Claims, 3 Drawing Sheets

(56) References Cited

U.S. PATENT DOCUMENTS

| | | | | |
|---|---|---|---|---|
| 6,162,984 | A | 12/2000 | Engard | |
| 6,240,930 | B1 * | 6/2001 | Yuhara | 132/293 |
| 6,378,173 | B1 * | 4/2002 | Ho et al. | 16/373 |
| 6,476,309 | B2 | 11/2002 | Gaglio | |
| 6,846,981 | B2 | 1/2005 | Devers | |
| 6,849,792 | B2 | 2/2005 | Yeakel | |
| 6,992,243 | B2 | 1/2006 | Small | |
| 7,060,888 | B2 * | 6/2006 | Spalt | 84/727 |
| 7,285,714 | B2 | 10/2007 | Juszkiewics et al. | |
| 7,375,276 | B2 | 5/2008 | Kanayama et al. | |
| 7,838,758 | B2 * | 11/2010 | Van Ekstrom | 84/743 |
| 7,994,413 | B2 | 8/2011 | Salo | |
| 8,178,774 | B2 * | 5/2012 | Salehi | 84/726 |
| 8,283,552 | B2 * | 10/2012 | van Ekstrom | 84/743 |
| 8,575,466 | B2 * | 11/2013 | van Ekstrom | 84/743 |
| 8,680,389 | B2 * | 3/2014 | Yamanaka | 84/725 |
| 2002/0152659 | A1 * | 10/2002 | Hartill | 40/661 |
| 2003/0140938 | A1 * | 7/2003 | Evans et al. | 132/325 |
| 2005/0120871 | A1 * | 6/2005 | Spalt | 84/743 |
| 2007/0245884 | A1 * | 10/2007 | Yamaya | 84/731 |
| 2008/0164259 | A1 * | 7/2008 | Coe et al. | 220/520 |
| 2008/0168884 | A1 * | 7/2008 | Redard | 84/329 |
| 2009/0183626 | A1 * | 7/2009 | Salehi | 84/726 |
| 2011/0232465 | A1 * | 9/2011 | Salehi | 84/726 |
| 2012/0028297 | A1 * | 2/2012 | Zook et al. | 435/39 |
| 2012/0262618 | A1 * | 10/2012 | Weakly | 348/333.01 |
| 2013/0098228 | A1 * | 4/2013 | Tetsuro | 84/730 |
| 2013/0327202 | A1 * | 12/2013 | Mills | 84/726 |

OTHER PUBLICATIONS http://www.mylespaul.com/forums/pickups/184398-broke-my-f-kin-pup-changing-magnet.html (Demonstrating need) http://www.ehow.com/how_7597119_change-magnets-fender-squier-pickups.html (Non obvious).

* cited by examiner 1a
1b
2
3
4
5
X
Y

X
Y

X
Y

UNIVERSAL PICKUP

PRIOR ART

| | | |
|---|---|---|
| 2,455,575 | December 1948 | Fender et al. |
| 2,896,491 | July 1959 | Lover |
| 2,933,967 | April 1960 | Riscol |
| 3,035,472 | May 1962 | Freeman |
| 3,249,677 | May 1966 | Burns et al. |
| 3,585,424 | June 1971 | Neel |
| 4,096,780 | June 1978 | Dawson |
| 4,145,944 | March 1979 | Helpinstill, II |
| 4,348,930 | September 1982 | Chobanian et al. |
| 4,372,187 | February 1983 | Berg |
| 4,499,809 | February 1985 | Clevinger |
| 4,534,258 | August 1985 | Anderson |
| 4,535,668 | August 1985 | Schaller |
| 4,581,974 | April 1986 | Fender |
| 4,624,172 | November 1986 | McDougall |
| 5,111,728 | May 1992 | Blucher et al. |
| 5,148,733 | September 1992 | Beller |
| 5,292,998 | March 1994 | Knapp |
| 5,335,576 | August 1994 | Hayashi |
| 5,336,845 | August 1994 | Lace, Sr. |
| 5,389,731 | February 1995 | Lace |
| 5,523,526 | June 1996 | Shattil |
| 5,530,199 | June 1996 | Blucher |
| 5,567,903 | October 1996 | Coopersmith et al. |
| 5,610,357 | March 1997 | Frank-Braun |
| 6,043,422 | March 2000 | Chapman |
| 6,162,984 | December 2000 | Engard |
| 6,476,309 | November 2002 | Gaglio |
| 6,846,981 | January 2005 | Devers |
| 6,849,792 | February 2005 | Yeakel |
| 6,992,243 | January 2006 | Small |
| 7,285,714 | October 2007 | Juszkiewicz et al. |
| 7,375,276 | May 2008 | Kanayama et al. |
| 2002/0069749 | June 2002 | Hoover et al. |
| 2003/0051596 | March 2003 | Gustafsson |
| 2005/0076775 | April 2005 | Small |
| 2005/0126377 | June 2005 | Kanayama et al. |
| 2006/0112816 | June 2006 | Kinman |
| 2006/0150806 | July 2006 | Hara |
| 2006/0272469 | December 2006 | Meisel |
| 2007/0056435 | March 2007 | Juszkiewicz et al. |
| 7,994,413 | August 2011 | Salo |
| 2,455,575 | December 1948 | Fender et al. |
| 2,896,491 | July 1959 | Lover |

BACKGROUND

In general, a pickup is a coil of conductive wire wrapped around or glued to a permanent magnet. Nearby vibrating metal strings induce an alternating current at the frequency of vibration.

Prior to the embodiments of the present invention, there were only non-removable magnets in guitar pickups, meaning that the pickup only got the tonal characteristics of one type of magnet, and if a guitarist wanted a different tone, they would need to buy a different pickup all together, an expensive endeavor, or to take apart the pickup and force the magnet out, which is dangerous, difficult, voids the warranty of many pickups, and can only be done a finite number of times before the screws get stripped or the bobbins get over-drilled and structural integrity is compromised. In most types of pickups, it is desirable to keep magnets in place to avoid distortions in sound.

There are three types of standard pickups widely sold, the humbucker, single coil, and p90. A normal, standard humbucking guitar pickup has the following major components: a baseplate, a magnet, two coils, and 12 pole pieces, six on each coil. The coils are suspended over the baseplate by friction between the pole pieces, leaving a cavity between the two rows of pole pieces. This is where the bar magnet is glued or otherwise fixed in the pickup.

A normal, industry standard P90 has the following major components: two plastic/fiber bobbins, a wooden spacer, a metal spacer, a solid metal baseplate, and six pole pieces/screws (both to keep the pickup together and to conduct magnetic current). The bobbins are separated by the wooden spacer vertically, and around the spacer is wrapped the wire coil. The bottom bobbin (now connected to the completed coil) is then placed on top of the metal spacer, which is then placed on top of the baseplate. The magnets are epoxied on either side of the spacer, and the pickup is screwed together.

The single coil pickup is normally composed of these major parts: two magnets, two bobbins, a wooden spacer, and six pole pieces. The bobbins are placed on either side of the wooden spacer, and the coil is wrapped around the wooden spacer and in between the bobbins, creating the coil. Pole pieces are inserted through the bobbins and spacer and out the other end, sticking out a bit. Magnets are epoxied on either side of the part of the pole pieces that sticks out of the framework.

SUMMARY

A baseplate for an electromagnetic pickup that provides for more varied, more pleasing, louder, or in general, different types of sounds from the instrument as a result of changing the type, shape, strength, or other characteristic of the magnet, which in turn changes the magnetic characteristics of the field and the sound of the instrument. When a user would like to change their tone, all they have to do is get access to the apparatus, switch out the magnets, and replace the pickup, and the effect is a completely different sound. In tandem with a coil tap, one can get almost every sound possible from any guitar pickup without paying thousands of dollars to buy more and more of them for different sounds. Even alone, without a coil tap, much of the same goal is achieved. Additionally, in tandem with an apparatus that allows one to access the pickup easily, this would make it so easy to change magnets that one could do so in the middle of a show. All in all, what we have here is an extremely useful, novel apparatus that musicians can use to tailor their sounds to different types of music by changing magnets.

DESCRIPTION OF DRAWINGS

FIG. 1 is a top view of the baseplate. FIG. 2 is a side view of the baseplate turned upside down, having been rotated 90 degrees over the x axis. FIG. 3 is a side view of the baseplate turned right-side up, having been rotated 90 degrees over the x axis in the other direction. FIGS. 4 and 5 are oblique views of the baseplate, having been rotated 45 degrees over the x-axis and the y-axis. FIGS. 6 and 9 are small-side views of the baseplate, having been rotated 90 degrees over the y axis. FIGS. 7 and 8 are oblique views of the baseplate, having been rotated 45 degrees over the x axis and the y axis in the opposite directions as FIGS. 4 and 5.

FIG. 1 is a top view of the baseplate. FIG. 2 is a side view of the baseplate turned upside down, having been rotated 90 degrees over the x axis. FIG. 3 is a side view of the baseplate turned right-side up, having been rotated 90 degrees over the x axis in the other direction. FIGS. 4 and 5 are oblique views of the baseplate, having been rotated 45 degrees over the x axis and the y axis. FIGS. 6 and 9 are small-side views of the baseplate, having been rotated 90 degrees over the y axis. FIGS. 7 and 8 are oblique views of the baseplate, having been rotated 45 degrees over the x axis and the y axis in the opposite directions as FIGS. 4 and 5.

FIG. 1 is a top view of the pickup. FIG. 2 is a side view of the pickup turned upside down, having been rotated 90 degrees over the x axis. FIG. 3 is a side view of the pickup turned right-side up, having been rotated 90 degrees over the x axis in the other direction. FIGS. 4 and 5 are oblique views of the pickup, having been rotated 45 degrees over the x axis and the y axis. FIGS. 6 and 9 are small-side views of the pickup, having been rotated 90 degrees over the y axis. FIGS. 7 and 8 are oblique views of the pickup, having been rotated 45 degrees over the x axis and the y axis in the opposite directions as FIGS. 4 and 5.

DETAILED DESCRIPTION

Embodiments of the present invention allows the user to arbitrarily exchange magnets without the hassle of soldering or the expense of a completely new coil and pickup, and makes modification of sound much easier. Additionally, if used in conjunction with an apparatus that allows the pickup to be removed from the guitar without a screwdriver, then the embodiments of the present invention allow the user a fast way to get a completely different tone almost immediately. This effect is enhanced even more by the possible addition of a coil tap, creating a tonally adjustable pickup.

The embodiments of the present invention are improvements on standard pickups. If a baseplate as described in the claims is present on the bottom of a pickup, switching out magnets in order to get a different tone is made simple and cost-effective in comparison to purchasing and installing a completely new pickup.

All types of pickups, including stacked humbuckers, single coils, lace sensors, p90s, rail buckers, etc. could all benefit in the same way from the ideas in this invention.

Another benefit of the embodiments of the present invention is that it requires no soldering to change the tone after the initial installation of the pickup, so it will be easier for people to get a different sound even if they do have multiple pickups.

Additionally, all forms of the embodiments of the present invention, if built with appropriate materials, provide extra shielding from RF interference, which increases sound quality of the pickup.

Although there are various modifications and embodiments of the present invention, it should be understood that any such embodiments and modifications fall under the scope, spirit, and essence of the current invention and its contribution to the art.

Embodiment 1

Humbucker

The first embodiment of the current invention is, in essence, a new baseplate for a humbucking pickup that allows the user to change magnets, thus changing the strength, shape, and structure of the magnetic field.

Figures 1, 2, 3, 4, 5, 6, 7, 8, 9:
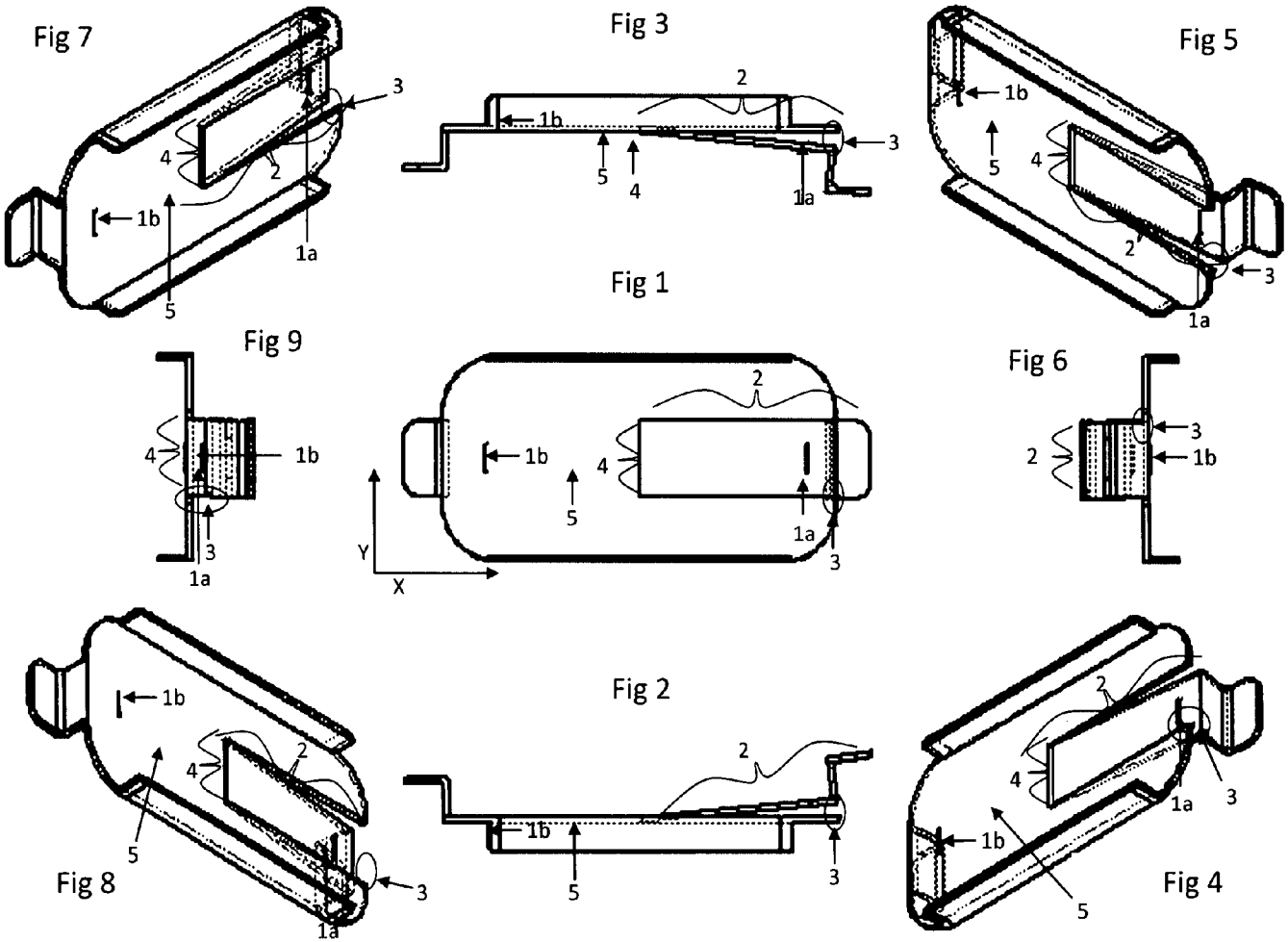
FIGS. 1-9 are of a humbucker embodiment of the invention. They are in the standard engineering 9-view, in which the pickup or baseplate is drawn as it would look if you rotated it onto the part of the sheet the drawing is located on, the axis of revolution being parallel to the side of the paper the pickup is being drawn on. Therefore.

Refer to FIGS. 1-9 of in the drawings to see the way this baseplate is structured. A "wing" (2) attached to the plate (5) by a hinge (4) replaces the normal, solid plate structure that is normally in that place. A locking mechanism (3), a locking hinge, or any apparatus that keeps the wing in place and allows for it to be moved can be used to make sure the pickup doesn't become unstable. This allows for the user to swing out the "wing" (2), slide out the magnet from the pickup (which is located in between 1*a* and 1*b*), and replace the magnet. As the magnet slides into the pickup, it is stopped in the correct place by a small "tooth" (1*b*) that keeps it from being displaced as the pickup is moved around. Once the "wing" (2) is closed, another "tooth" (1*a*) keeps the magnet in place from the other direction. The magnet is kept static longitudinally (along the Y-axis in reference to FIG. 1) by the other various apparatuses that are present in humbucking pickups. In some embodiments, two more teeth could be added running latitudinally (along the X axis in reference to FIG. 1) to keep it in place this way.

Other ways this aspect of the invention could be built include but are not limited to: different types of locking mechanisms, including but not limited to locking hinges either running latitudinally or longitudinally that would allow magnet removal and secural by locking at, for example, a 180 degree angle, slideable locks that could keep moving parts of the pickup in place, and once unlocked, allowed for removal of the magnet, and "snaps" that could act as ways to secure moving parts of the pickup that swing out latitudinally, longitudinally, or vertically (along the z axis in reference to FIG. 1), and when un-snapped could allow for magnet removal; "wings" that are shaped differently (rectangular, square, triangular, et cetera, are smaller in size, or come out in different ways (i.e. longitudinally or longitudinally instead of vertically); different mechanisms to keep the magnet in place (i.e. springs running longitudinally that support the magnet and keep it from moving, be they attached to the moving part, within the pickup's body itself, or attached in any other place, or an indentation running longitudinally or latitudinally and depressed vertically in the shape of the magnet to lock it in place instead of "teeth" (1*a* and 1*b*)); different materials used in the 146 baseplate (for example, aluminum nickel-alloys, brass, or any other material); and the abandonment of "wings" (2) in favor of a simple indentation or slot with a method of securing the pickup such as a "door" running latitudinally or longitudinally that could slideably or swingingly move to secure or allow removal of the pickup; "hooks" protruding vertically from the baseplate to keep the magnet from falling out without having to epoxy it; or in general any sort of mechanical magnet changing system that allows the user to take the magnet in and out of the pickup.

Embodiment 2

P90

The second embodiment of the current invention is in essence a new type of baseplate for a P90 pickup that allows the user to change magnets, thus changing the strength, shape, and structure of the magnetic field.

Figures 10, 11, 12, 13, 14, 15, 16, 17, 18:
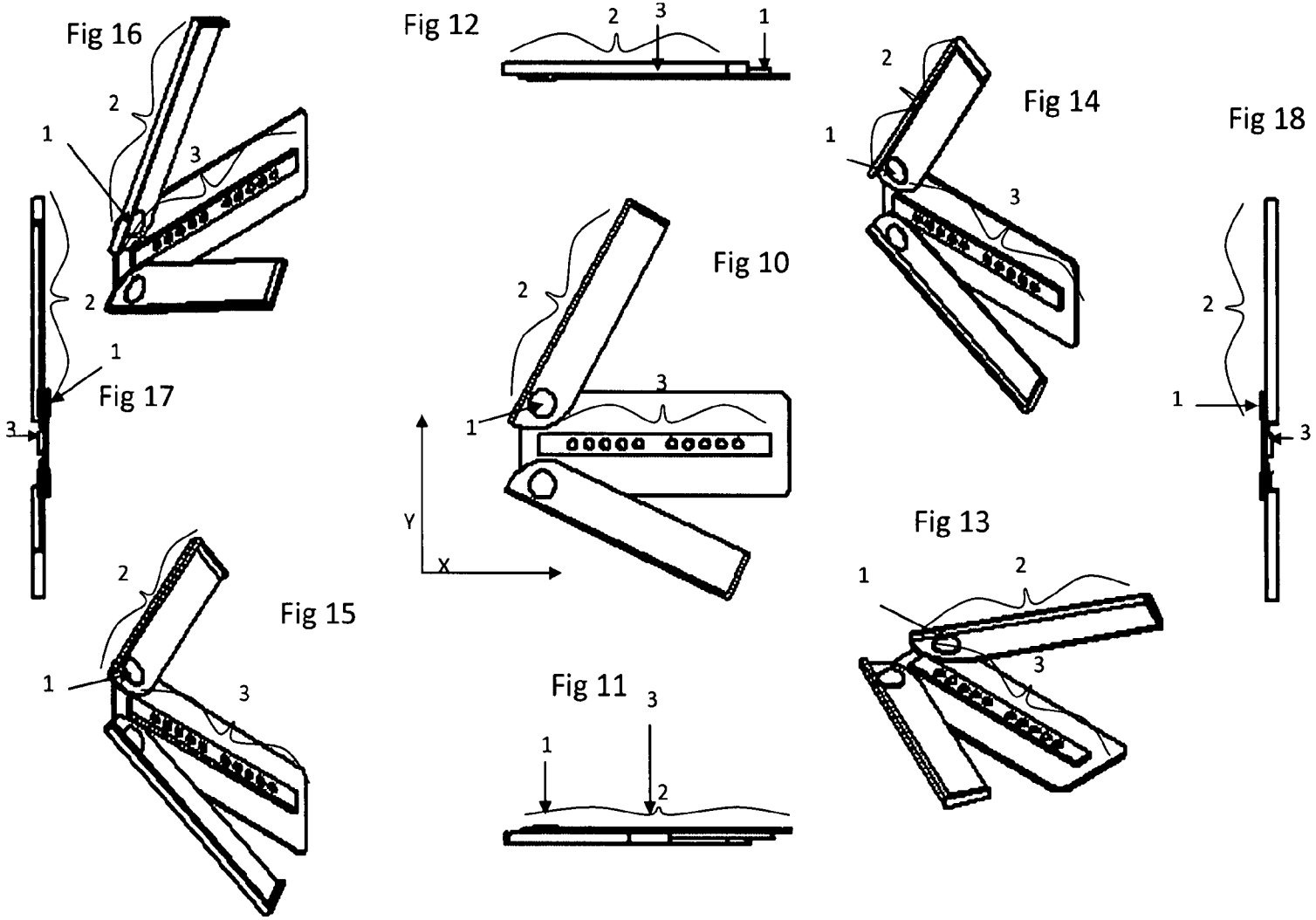
FIGS. 10-18 are of a P-90 embodiment of the invention. They are in the standard engineering 9-view, in which the pickup or baseplate is drawn as it would look if you rotated it onto the part of the sheet the drawing is located on, the axis of revolution being parallel to the side of the paper the pickup is being drawn on. Therefore.

FIGS. 10-18 of the drawings show its different views. In essence, this baseplate is different from the standard P90 due to the "wings" (2) that swing out longitudinally from the pickup. They swing out from a pivot joint (1). To change magnets, the "wings" are swung out, the magnet is taken out from its holding place in the wing (or from the inside of the pickup), a new magnet is placed into the wing, and the wing is swung back in. Due to the slightly large size of some wings, a taller metal spacer (3) may be necessary to put the pickup together.

Other ways this aspect of the invention could be built include but are not limited to: different types of locking mechanisms, including but not limited to locking hinges either running latitudinally or longitudinally that would allow magnet removal, slideable locks that could keep moving parts of the pickup in place, and once unlocked, allow for removal of the magnet, and "snaps" that could act as ways to secure moving parts of the pickup that swing out latitudinally, longitudinally, or vertically (along the z axis in reference to FIG. 10), and when un-snapped could allow for magnet removal; "wings" that are shaped differently (rectangular, square, triangular, et cetera, are smaller in size, or come out in different ways (i.e. longitudinally or latitudinally instead of vertically); different mechanisms to keep the magnet in place (i.e. springs running longitudinally or latitudinally that support the magnet and keep it from moving, be they attached to the moving part, within the pickup's body itself, or attached in any other place, or an indentation running longitudinally or latitudinally and depressed vertically in the shape of the magnet to lock it in place instead of "teeth" (1*a* and 1*b*)); different materials used in the baseplate (for example, aluminum nickel-alloys, brass, or any other material); "wings" that slide out instead of swinging out, different types of joints to keep the "wings" in place (such as a simple screw and nut instead of the pivot joint (1)), and the abandonment of "wings" (2) in favor of a simple indentation or slot with a method of securing the pickup such as a "door" running latitudinally, longitudinally, or vertically that could slideably or swingingly move to secure or allow removal of the pickup; "hooks" protruding vertically from the baseplate to keep the magnet from falling out without having to epoxy it; or in general any sort of mechanical magnet changing system that allows the user to take the magnet in and out of the pickup.

Embodiment 3

Single Coil

The third embodiment is essentially a new type of baseplate for a single coil pickup that allows the user to change magnets, thus changing the strength, shape, and structure of the magnetic field.

Figures 19, 20, 21, 22, 23, 24, 25, 26, 27:
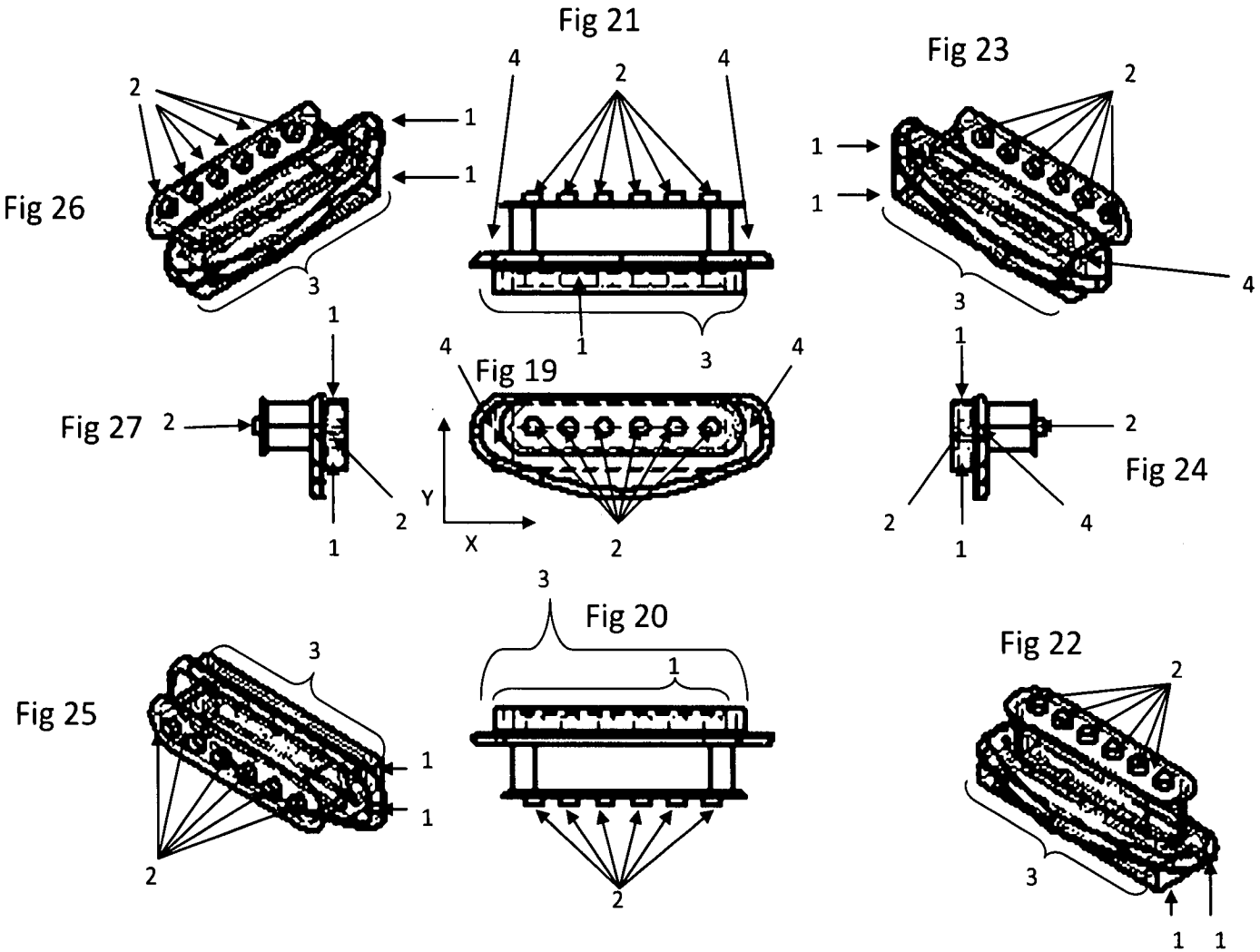
FIGS. 19-27 are of a single-coil embodiment of the invention. They are in the standard engineering 9-view, in which the pickup or baseplate is drawn as it would look if you rotated it onto the part of the sheet the drawing is located on, the axis of revolution being parallel to the side of the paper the pickup is being drawn on. Therefore.

Refer to FIGS. 19-27 for the final part of the current invention. The final part of the current invention is a type of case/baseplate (3) that can be screwed on and off of the pickup (with thumb screws, to be user friendly) (4) and keeps the magnets in place, allowing for interchangement of magnets (1) by replacing them in the case. The magnets are kept still by the protrusion of the pole pieces (2) that act as a spacer. The embodiments of the present invention also has the added benefit of acting as extra shielding to the pickup if made from the right material, and can be conducive to stopping RF interference. Other embodiments could benefit in the same way. Other ways this aspect of the invention could be built include but are not limited to: building a larger or smaller case for the magnets; building a case for the magnets that was screwed on to the pickup in a different way; building a case for the magnets that swung off or did not screw onto the pickup at all, including but not limited to a similar case that would swing out and have a method of being secured back in place; and a case that didn't have to be fully removed, but from which the magnets could be removed.

The present invention has been described in an illustrative manner. It is to be understood that the terminology which has been used is intended to be in the nature of words of description rather than of limitation.

The preceding are but three of the various modifications and embodiments of the embodiments of the present invention. It should be understood that other embodiments and modifications will fall under the scope, spirit, and essence of the current invention and its contribution to the art.

The invention claimed is:

1. A pickup for a stringed musical instrument having a baseplate adapted to allow removal and replacement of at least one magnet without irreversible modification to the musical instrument pickup, the baseplate comprising at least one wing or casing adapted to swingingly or slideably allow removal and replacement of the at least one magnet without requiring removal of the baseplate from the pickup.

2. The pickup as set forth in claim 1 wherein the wing comprises a raised portion that secures the magnet(s) in place.

3. The pickup as set forth in claim 1 wherein the wing comprises a cavity or indentation that secures the magnet(s) in place.

4. The pickup as set forth in claim 1 wherein the baseplate comprises a locking hinge.

5. The pickup as set forth in claim 1 wherein the wing has a means of being secured into place.

6. The pickup as set forth in claim 1 wherein the wing comprises one or more tabs adapted to secure the magnet(s) into place along a longitudinal axis of the pickup.

7. The pickup as set forth in claim 1 wherein the wing is attached to the baseplate by a pivot joint or hinge joint.

8. The pickup as set forth in claim 1 wherein the wing comprises one or more tabs adapted to secure the magnet(s) into place along a latitudinal axis of the pickup.

9. The pickup as set forth in claim 1 wherein the wing shields the pickup from electromagnetic interference.

10. The pickup as set forth in claim 1 wherein the wing has a means of preventing magnet vibration.

11. A baseplate for a stringed musical instrument pickup adapted to allow removal and replacement of at least one magnet without irreversible modification to the musical instrument pickup, the baseplate comprising at least one wing or casing adapted to swingingly or slideably allow removal and replacement of the at least one magnet without requiring removal of the baseplate from the pickup.

12. The pickup as set forth in claim 11 wherein the wing comprises a raised portion that secures the magnet(s) in place.

13. The pickup as set forth in claim 11 wherein the wing comprises a cavity or indentation that secures the magnet(s) in place.

14. The pickup as set forth in claim 11 wherein the baseplate comprises a locking hinge.

15. The pickup as set forth in claim 11 wherein the wing has a means of being secured into place.

16. The pickup as set forth in claim 11 wherein the wing comprises one or more tabs adapted to secure the magnet(s) into place along a longitudinal axis of the pickup.

17. The pickup as set forth in claim 11 wherein the wing is attached to the baseplate by a pivot joint or hinge joint.

18. The pickup as set forth in claim 11 wherein the wing comprises one or more tabs adapted to secure the magnet(s) into place along a latitudinal axis of the pickup.

19. The pickup as set forth in claim 11 wherein the wing shields the pickup from electromagnetic interference.

20. The pickup as set forth in claim 11 wherein the wing has a means of preventing magnet vibration.

* * * * *